United States Patent [19]

Knowles et al.

[11] 4,417,669

[45] Nov. 29, 1983

[54] MULTIPLE BAG DISPENSER

[76] Inventors: Henry L. Knowles, 1030 E. Bethany Home Rd., Phoenix, Ariz. 85014; James P. Winningham, 3043 N. 36th St., Apt. #1, Phoenix, Ariz. 85018

[21] Appl. No.: 325,986

[22] Filed: Nov. 30, 1981

[51] Int. Cl.[3] ..... B65H 3/58

[52] U.S. Cl. ..... 221/26; 206/554; 248/101

[58] Field of Search ..... 221/26; 53/390; 248/101, 108, 95; 206/554

[56] References Cited

U.S. PATENT DOCUMENTS

| | | | |
|---|---|---|---|
| 3,285,406 | 11/1966 | Winesett | 221/26 |
| 3,417,863 | 12/1968 | Paxton | 206/554 |
| 3,563,505 | 2/1971 | Langley | 248/101 |

FOREIGN PATENT DOCUMENTS

| | | | |
|---|---|---|---|
| 690150 | 7/1964 | Canada | 206/554 |

*Primary Examiner*—Joseph J. Rolla
*Assistant Examiner*—Kenneth Noland
*Attorney, Agent, or Firm*—Cahill, Sutton & Thomas

[57] ABSTRACT

A multiple bag dispenser includes a plurality of nested bags having an exposed inner bag. Each bag includes a detachable lip and a bag body having a mouth which is coupled to the lip. A retaining ring assembly grips the lips of the nested bags and maintains an opening at the mouth of each bag. A tearing pin and a plurality of securing pins couple the nested bags to the retaining ring assembly and permit the bag lip to be detached from the exposed bag to permit removal of the exposed bag from the retaining ring assembly.

19 Claims, 16 Drawing Figures

FIG. 1
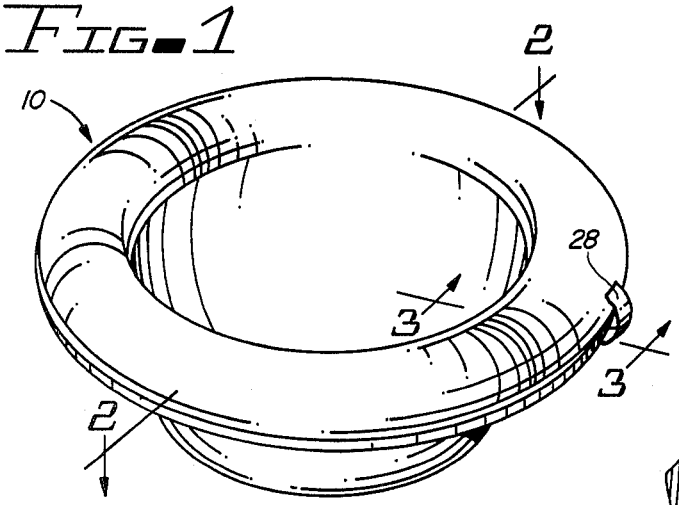
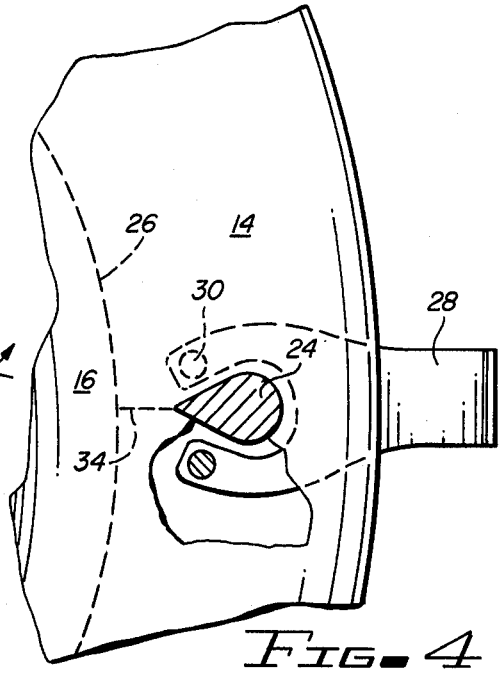
FIG. 4
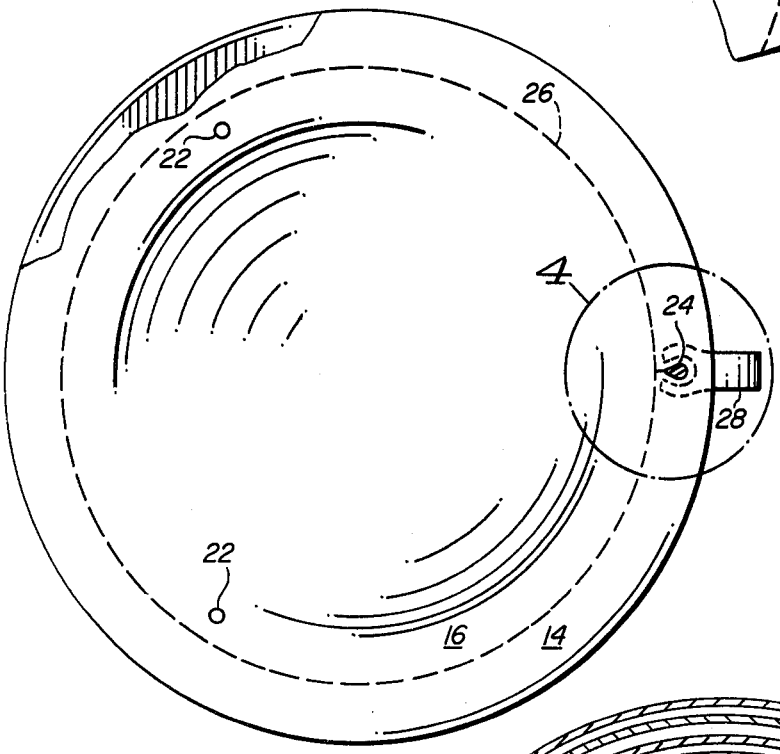
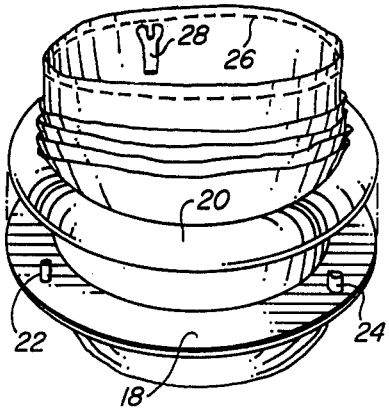
FIG. 5
FIG. 2
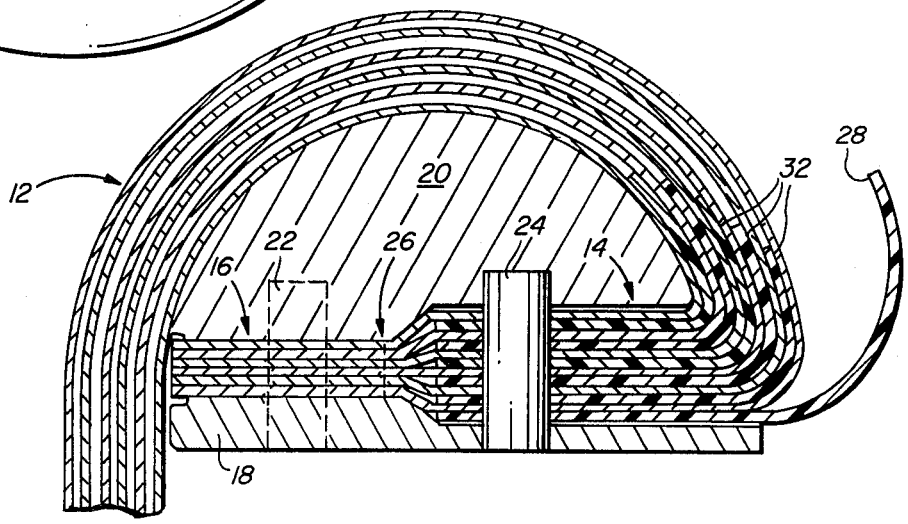
FIG. 3

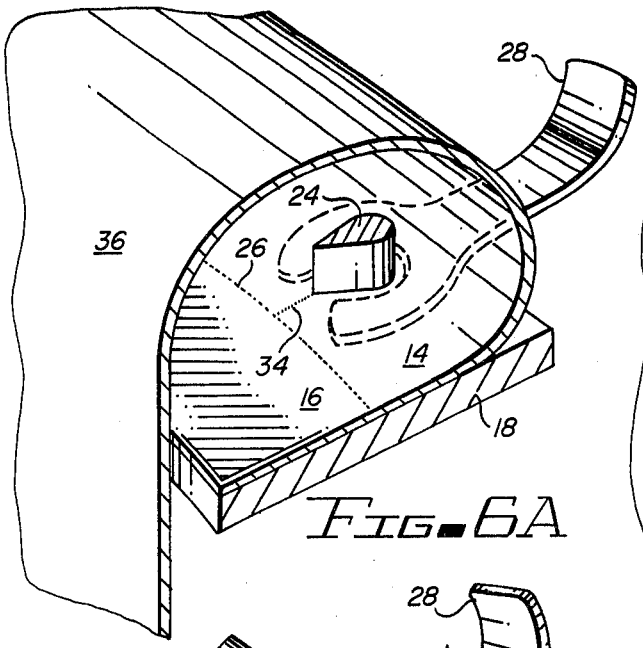
FIG. 6A
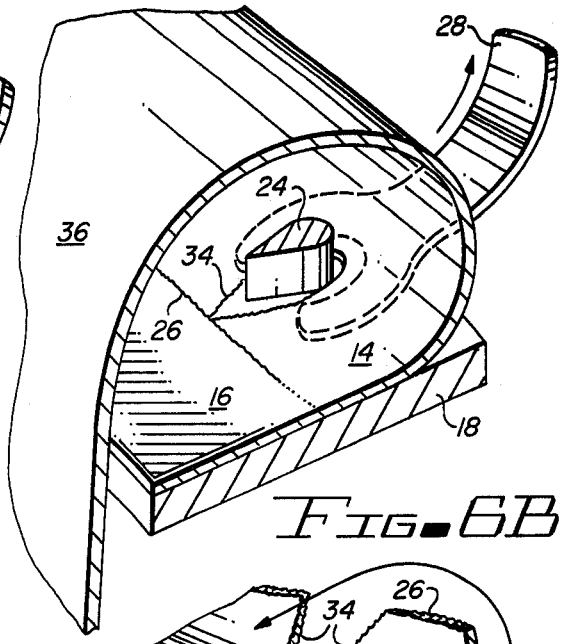
FIG. 6B
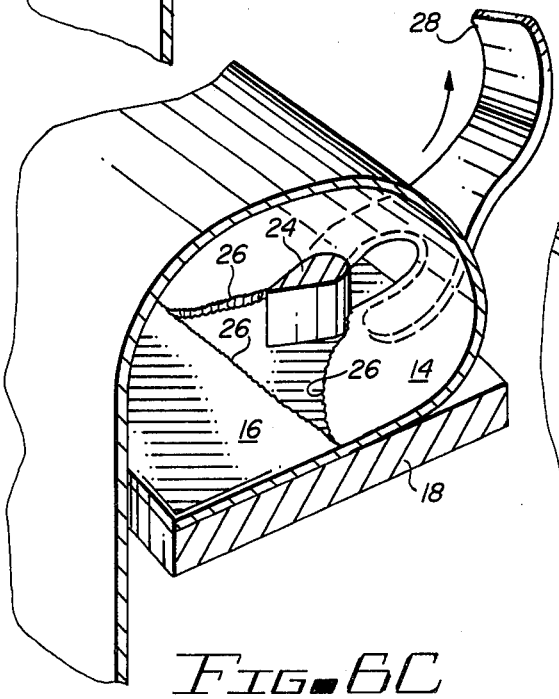
FIG. 6C
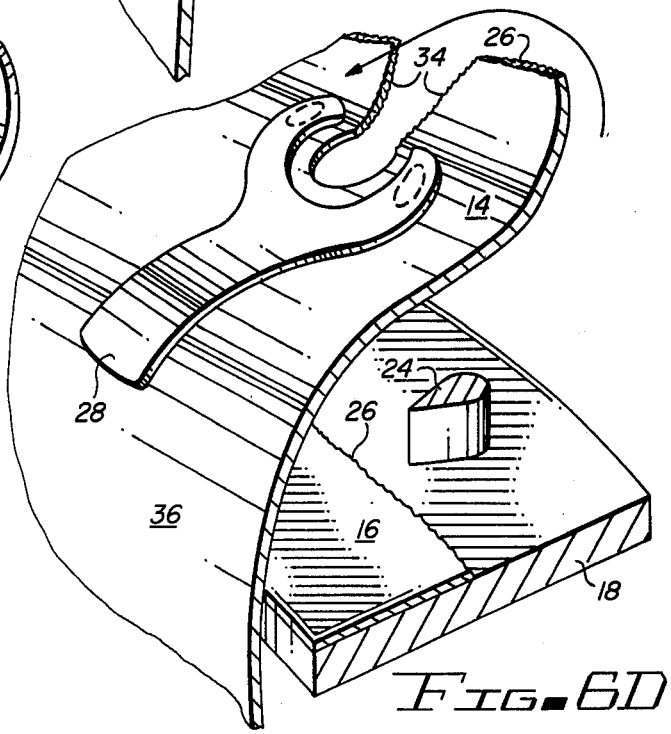
FIG. 6D
FIG. 8
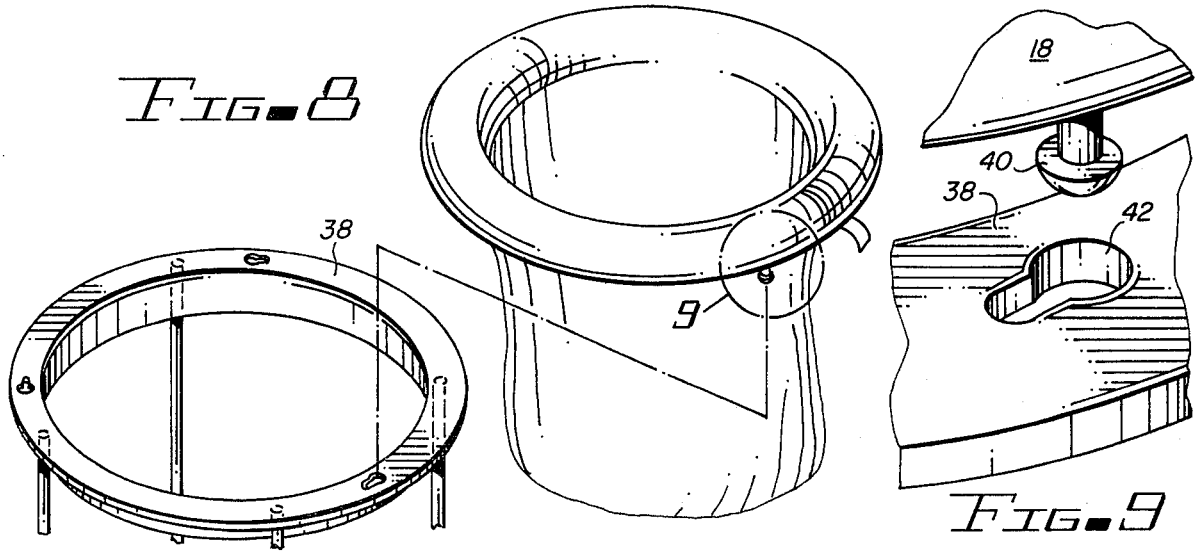
FIG. 9

FIG. 10
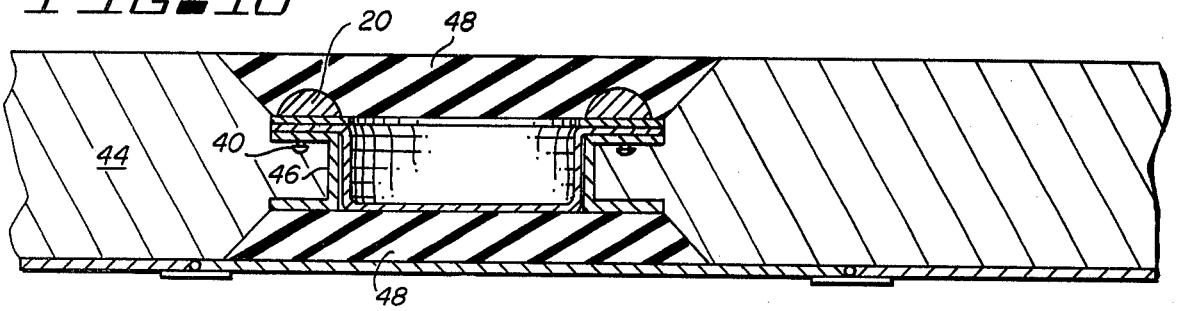
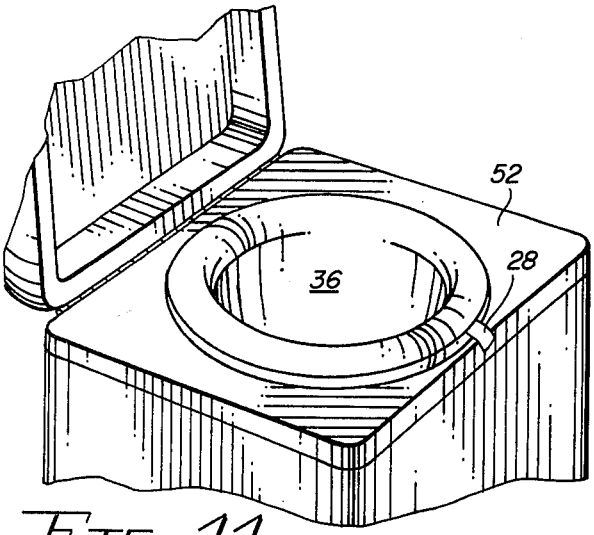
FIG. 11
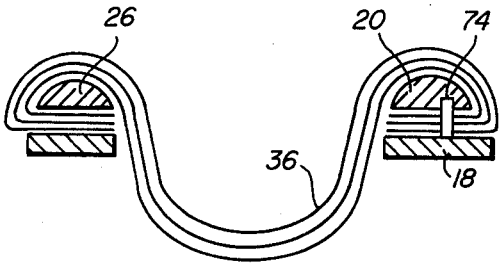
FIG. 7
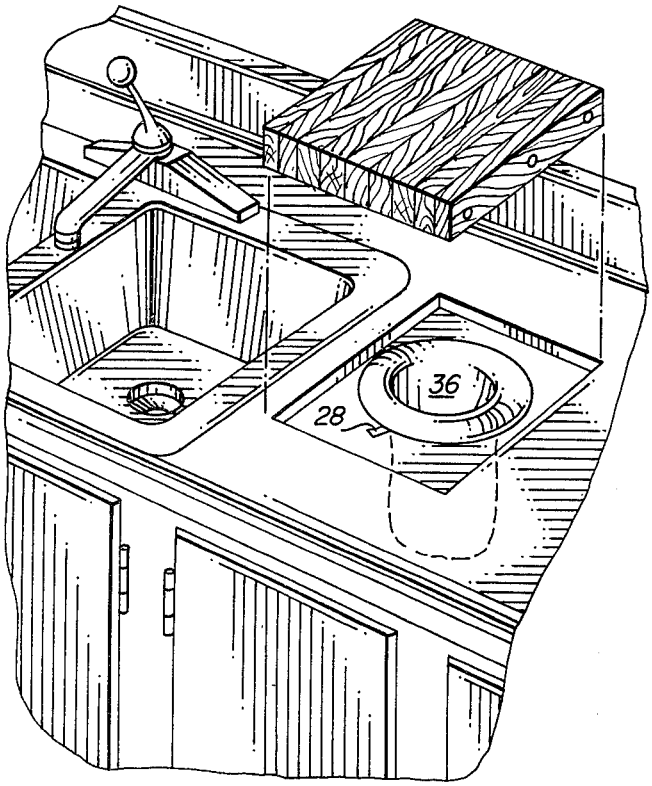
FIG. 12
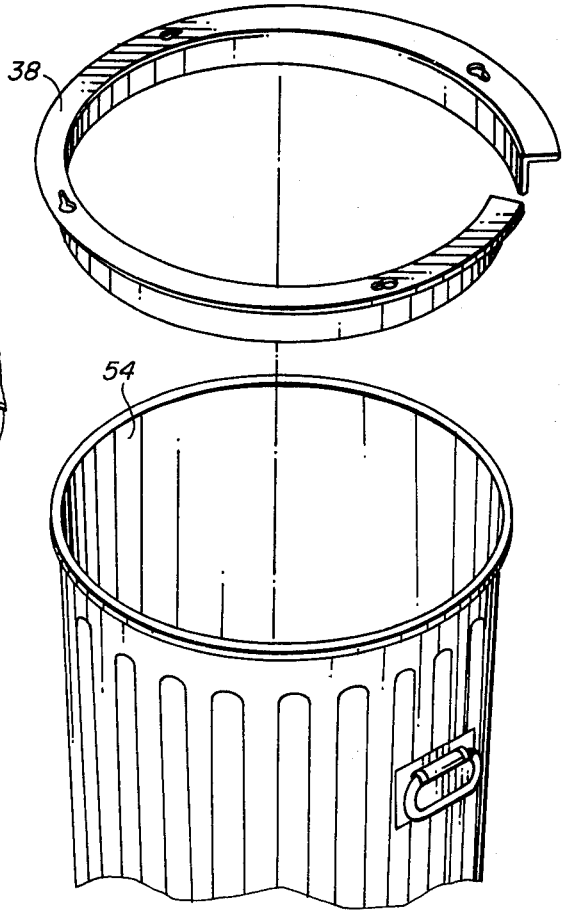
FIG. 13

MULTIPLE BAG DISPENSER

BACKGROUND OF THE INVENTION

1. Field of the Invention

This invention relates to multiple bag dispenser assemblies, and more particularly, to a multiple bag dispenser including a plurality of nested bags.

2. Description of the Prior Art

Multiple bag dispensers have been manufactured in a variety of different configurations. In supermarkets, a plurality of plastic bags coupled together in an end to end relationship are rolled onto a cylindrical retainer tube. After each individual bag is ripped from the dispenser roll, the open end must be identified and then manually opened. Certain types of plastic sandwich bags are maintained in a folded configuration in a multiple bag dispenser unit and dispensed one at a time in a manner similar to disposable paper tissue dispensers. Each of the above-described multiple bag dispensing systems requires that the user locate and open the mouth of the bag to insert material into the bag interior.

Disposable plastic bags are utilized as trash can liners, garbage can liners, and in certain applications, as disposable liners for hospital bed pans. U.S. Pat. No. 4,011,610 (Parker) discloses a bed pan system which is disposed within the interior of a hospital mattress. This bed pan system includes a single disposable liner to eliminate the requirement for removing or cleaning the bed pan housing after a patient has used the bed pan. U.S. Pat. No. 3,849,811 (Cyll) discloses a single plastic disposable bag which is positioned within and which extends below the bottom of a hospital bed for the purpose of providing a disposable plastic waste receptacle. U.S. Pat. No. 4,244,066 (Rukawina) discloses a single use receptacle which is located within a hospital bed and which serves the function of a bed pan. Other related bed pan systems are disclosed in the following U.S. Pat. Nos.: 2,615,175 (Corakas); Des. 246,382 (Parker); and 1,286,516 (Bowron).

SUMMARY OF THE INVENTION

It is therefore a primary object of the present invention to provide a multiple bag dispenser which maintains a plurality of nested bags in a cartridge-like dispenser having an open mouth.

Another object of the present invention is to provide a multiple bag dispenser which permits the innermost, exposed bag to be rapidly and easily removed from the dispenser assembly and discarded.

Yet another object of the present invention is to provide a multiple bag dispenser which incorporates a plurality of plastic bags each of which includes a detachable lip.

Still another object of the present invention is to provide a multiple bag dispenser which includes a pull tab which permits the innermost exposed bag to be readily detached from the bag dispenser and discarded.

Briefly stated, and in accord with one embodiment of the invention, a multiple bag dispenser includes a plurality of nested bags having an exposed inner bag. Each bag includes a detachable lip and a bag body having a mouth which is coupled to the lip. A retainer ring assembly grips the lips of the nested bags and maintains an opening at the mouth of each bag. A pull tab/tearing pin system permits the lip of an exposed bag to be readily separated from the body of the bag to permit removal of the innermost exposed bag from the retaining assembly.

DESCRIPTION OF THE DRAWINGS

The invention is pointed out with particularity in the appended claims. However, other objects and advantages together with the operation of the invention may be better understood by reference to the following detailed description and taken in connection with the following illustrations wherein:

FIG. 1 is a perspective view of a multiple bag dispenser according to the present invention.

FIG. 2 is a sectional view of the multiple bag dispenser illustrated in FIG. 1, taken along section line 2—2.

FIG. 3 is a sectional view of the multiple bag dispenser illustrated in FIG. 1, taken along section line 3—3. The dotted line depiction of a single securing pin is for the purpose of illustrating the relative radial positioning of a securing pin with respect to the tearing pin and does not indicate that the securing pin depicted is radially aligned with the tearing pin.

FIG. 4 is an enlarged elevational view of the tearing pin and bag mouth and lip taken from the encircled section of FIG. 2.

FIG. 5 is an exploded perspective view of the present invention showing the various elements of the retaining ring assembly together with a plurality of nested bags.

FIGS. 6A–D represents a plurality of enlarged perspective views illustrating the sequence which is followed to remove a single one of the plurality of nested bags from the retaining ring assembly.

FIG. 7 is a sectional view of a multiple bag dispenser of the present invention, particularly illustrating the manner in which the plurality of nested bags are secured to and supported by the retaining ring assembly of the present invention.

FIG. 8 illustrates the manner in which an adapter ring supported by four legs may be coupled to a multiple bag dispenser.

FIG. 9 is an enlarged view of the key lock fastening feature which couples together the multiple bag dispenser and adapter ring assembly illustrated in FIG. 8.

FIG. 10 is a partially cut away elevational view indicating the manner in which a multiple bag dispenser of the present invention can be coupled to various supporting elements and positioned within a hospital mattress for the purpose of serving as a bed pan having a plurality of disposable bags.

FIG. 11 illustrates the manner in which the multiple bag dispenser of the present invention can be coupled to a support housing for the purpose of serving as a portable toilet.

FIG. 12 illustrates the manner in which the multiple bag dispenser of the present invention can be coupled to a kitchen countertop to serve as a trash receptacle having disposable bags.

FIG. 13 illustrates the manner in which an adapter ring can be coupled to an existing trash can for the purpose of receiving a multiple bag dispenser of the present invention.

DESCRIPTION OF THE PREFERRED EMBODIMENT

In order to better illustrate the advantages of the invention and its contributions to the art, a preferred hardware embodiment of the invention will now be described in detail.

Referring now to FIGS. 1-5, the multiple bag dispenser of the present invention includes a retaining ring assembly 10 which functions as a gripping means for securing a plurality of identical, nested plastic bags which are indicated generally by reference number 12 to retaining ring assembly 10. Each plastic bag includes a bag body having a mouth 14 and a lip 16 which is detachably coupled to mouth 14.

The retaining ring assembly 10 includes a bottom ring 18 and a top ring 20. A pair of securing pins indicated generally by reference number 22 extend vertically downward from upper ring 20 and are coupled to bottom ring 18. Tearing pin 24 extends vertically upward from bottom ring 18 and is coupled to top ring 20. As is best illustrated in FIG. 2, securing pins 22 and tearing pin 24 are spaced at equal intervals around bottom ring 18. Tearing pin 24 is positioned at a greater radial distance from the center of bottom ring 18 than are securing pins 22.

Each of the nested plastic bags includes two types of apertures. The first type of aperture has a cylindrical configuration and is located in the lip section 16 of the bag. The second type of aperture is configured to fit over tearing pin 24 and is located within the mouth section 14 of each bag. FIG. 2 also illustrates that a continuous perforation 26 defines the boundry between the lip 26 and mouth 14 of each bag.

In FIG. 3, a securing pin 22 is depicted by dotted lines to indicate the relative radial spacing between that securing pin and tearing pin 24. As is clear from a comparison of FIGS. 2 and 3, the securing pin 22 depicted in FIG. 3 is not radially aligned with tearing pin 24 and is only illustrated in FIG. 3 for the purpose of more clearly indicating the fact that securing pins 22 are coupled to lip 16 of the nested bags, while tearing pin 24 is coupled to the mouth of each of the nested bags.

A flexible plastic pull tab 28 includes a horseshoe-shaped end section which surrounds tearing pin 24 and which is coupled by a pair of plastic welds indicated generally by reference number 30 to the mouth of each single nested plastic bag. FIG. 3 illustrates that the outermost pull tab 28 is readily accessible, while the remaining plurality of pull tabs 32 are sandwiched between the layered bags.

FIG. 4 best illustrates that the right hand side of tearing pin 24 includes a dull, rounded edge which enables the outer surface of the tearing pin to function as a supporting pin for the purpose of supporting the weight of the material held within the interior of the innermost, exposed nested bag. The sharp, inner edge of tearing pin 24 is positioned adjacent to a perforated section of the mouth of the bag indicated by reference number 34 and assists in cutting perforation 34 when pull tab 24 is pulled in a radial outward direction.

Referring now to FIGS. 6A-D and FIG. 7, the manner in which the interior, exposed nested bag is removed from the multiple bag dispenser of the present invention will now be described in detail. To simplify the following explanation, FIG. 6 illustrates only the innermost, exposed nested bag 36, which has received refuse material and which is now to be discarded.

FIG. 6B illustrates that pull tab 28 has been displaced slightly in the direction of the arrow, causing the mouth 14 of bag 36 to be displaced with respect to the sharp left-hand edge of tearing pin 24. This outward displacement of the mouth 14 of bag 36 causes the perforation 34 to be torn and separated as illustrated. The two securing pins 22 and the clamping forces exerted between bottom ring 18 and top ring 20 cause the lip 16 of bag 36 to be maintained in a fixed position as illustrated.

FIG. 6C illustrates a further outward displacement of pull tab 28, causing the continuous perforation 26 to further separate mouth 14 from lip 16.

FIG. 6D illustrates that pull tab 28 has been displaced upward and inward with respect to bag 36 and that mouth 14 has been completely separated from lip 16 along the length of perforation 26. Once the mouth 14 of bag 36 has been completely detached from bag lip 16, the innermost, exposed bag can be completely lifted away from the multiple bag dispenser assembly and discarded. The next newly exposed, nested bag will now be available for use and will be completly free of any contamination caused by use of the previously discarded nested bag.

The sequential procedure illustrated in FIGS. 6A-D is repeated each time the user of the present invention desires to discard a soiled bag. When the last remaining bag has been disposed of, the retaining ring assembly including the plurality of retained bag lips 16 is disposed of.

Referring now to FIGS. 8 and 9, an adapter ring having four supporting legs is depicted. In this embodiment, bottom ring 18 of the retaining ring assembly includes a key lock feature incorporating a downwardly projecting male fastening device 40 which is adapted to be fitted within and rotated into a locking configuration within a female receptacle 42. In this configuration, the multiple bag dispenser of the present invention can function as a free standing trash receptacle or as a general purpose material storage device.

Referring now to FIG. 10, the multiple bag dispenser of the present invention is configured to function as a bed pan which is positioned within the interior of a hospital bed mattress 44. In this configuration, a cylindrical adapter ring 46 includes parallel oriented top and bottom surfaces which surround a notched section of mattress 44 to prevent vertical displacement of the multiple bag dispenser with respect to mattress 44. The curved contour of the top ring 20 of the multiple bag dispenser serves a function equivalent to a toilet seat. Semi-cylindrical top and bottom mattress inserts 48 provide smooth, continuous upper and lower surfaces for the section of mattress 44 in which the bed pan configuration of the present invention is positioned.

To utilize the bed pan configuration of the multiple bag dispenser depicted in FIG. 10, the upper mattress insert 48 is removed, exposing the innermost, nested bag. Following use of the multiple bag dispenser bed pan, the pull tab coupled to the exposed, innermost bag is pulled, enabling the soiled bag to be removed and discarded. The bed pan is then immediately ready for reuse, whereas in prior art systems discussed above, a replacement disposable plastic bag must be manually repositioned around the underlying bed pan structure.

Refering now to FIG. 11, the multiple bag dispenser of the present invention is shown coupled to a portable toilet enclosure 52. FIG. 12 illustrates that a multiple bag dispenser of the present invention may also be used as a disposable trash receptacle for a kitchen countertop. The bottom ring 18 of this dispenser configuration is coupled to underlying support structure by the key ring locking feature of the type disclosed in FIGS. 8 and 9 or by an equivalent coupling device. FIG. 13 illustrates that an adapter ring 38 fitted to a conventional trash can 54 readily enables the multiple bag dispenser of the present invention to be secured to the trash can to provide a pluraltiy of sequentially removable trash bags.

It will be apparent to those skilled in the art that the disclosed multiple bag dispenser may be modified in numerous ways and may assume many embodiments other than the preferred forms specifically set out and described above. For example, numerous different configurations and locations of securing pins, tearing pins and pull tabs would be readily apparent to one of ordinary skill in the art. While the embodiments discussed above have depicted a generally cylindrical retaining ring and nested bag assembly, numerous different, geometric configurations could readily be adapted for use in connection with the present invention. Accordingly, it is intended by the appended claims to cover all such modifications of the invention which fall within the true spirit and scope of the invention.

We claim:

1. A multiple bag dispenser comprising:

a. a plurality of nested bags sequentially positioned one inside another and having an exposed inner bag, each of said bags including
   i. a detachable lip;
   ii. a bag body having a mouth coupled to said lip;

b. a retaining ring assembly including an upper ring and a lower ring for gripping the lips of said nested bags and for maintaining an opening at the mouth of each of said nested bags; and c. a tearing pin extending between said upper ring and said lower ring and passing through an aperture in the mouth of each bag for separating the lip of an exposed bag from the body of said bag to permit removal of said exposed bag from said retaining ring assembly.

2. The bag dispenser of claim 1 wherein the lip of each of said bags includes an aperture and wherein said retaining ring assembly includes securing means extending between said upper ring and said lower ring and passing through the aperture and the lip of each bag for further coupling said bags to said retaining ring assembly.

3. The bag dispenser of claim 2 wherein said securing means includes a securing pin.

4. The bag dispenser of claim 1 wherein said separating means further includes a pull tab coupled to the mouth of each bag.

5. The bag dispenser of claim 4 wherein said pull tab partially surrounds said tearing pin.

6. The bag dispenser of claim 5 wherein said bag includes a continuous perforation between the mouth and the lip of said bag.

7. The bag dispenser of claim 6 wherein the inner surface of said tearing pin includes a pointed cutting surface.

8. The bag dispenser of claim 1 wherein the outer surface of said upper ring includes a rounded contour.

9. A multiple bag dispenser comprising:

a. a plurality of nested bags sequentially positioned one inside another and having an exposed inner bag, each of said bags including
   i. a detachable lip;
   ii. a bag body having a mouth coupled to said lip;

b. a retaining ring assembly including an upper ring and a lower ring for gripping the lips of said nested bags and for maintaining an opening at the mouth of each of said nested bags, wherein the mouth of each of said bags passes between the top and bottom rings, outward around the upper surface of said upper ring and through the interior of the upper and lower retaining rings; and c. means coupled to the mouth of each bag for separating the lip of an exposed bag from the body of said bag to permit removal of said exposed bag from said retaining ring assembly.

10. The bag dispenser of claim 9 wherein the lip of each of said bags includes an aperture and wherein said retaining ring assembly includes securing means extending between said upper ring and said lower ring and passing through the aperture in the lip of each bag for further coupling said bags to said retaining ring assembly.

11. The bag dispenser of claim 10 wherein the mouth of each of said bags includes an aperture and wherein said separating means includes a tearing pin extending between said upper ring and said lower ring and passing through said aperture in the mouth of each bag.

12. The bag dispenser of claim 11 wherein said separating means further includes a pull tab coupled to the mouth of each bag at a point positioned between the upper and lower rings and extending outward beyond said retaining ring assembly.

13. The bag dispenser of claim 12 wherein said pull tab surrounds said tearing pin.

14. The bag dispenser of claim 13 wherein said bag includes a continuous perforation between the mouth and the lip of said bag.

15. The bag dispenser of claim 12 further including means coupled to said retaining rings for securing said bag dispenser to a supporting structure.

16. The bag dispenser of claims 15 wherein said supporting structure includes an adapter ring coupled to and supported within an aperture centrally located within a mattress.

17. The bag dispenser of claim 16 further including upper and lower plugs in said mattress for enclosing said bag dispenser within said mattress.

18. A multiple bag dispenser comprising:

a. a plurality of nested bags having an exposed inner bag, each of said bags including
   i. a detachable lip;
   ii. a bag body having a mouth coupled to said lip and including an aperture;

b. a retaining ring assembly including an upper ring and a lower ring for gripping the lips of said nested bags and for maintaining an opening at the mouth of each of said nested bags;

c. a tearing pin extending between said upper ring and said lower ring and passing through said aperture in the mouth of each bag; and d. a pull tab coupled to the mouth of each bag for permitting the lip of said exposed bag to be separated from the body of said bag to remove said bag from said retaining ring assembly.

19. The bag dispenser of claim 18 wherein each bag includes a continuous perforation between the mouth and lip.

* * * * *